United States Patent [19]

Pennock

[11] 3,978,616

[45] Sept. 7, 1976

[54] PET DOOR

[75] Inventor: Everett C. Pennock, Minneapolis, Minn.

[73] Assignee: North States Industries, Inc., Minneapolis, Minn.

[22] Filed: June 4, 1975

[21] Appl. No.: 583,792

[52] U.S. Cl. ..... 49/386; 49/394

[51] Int. Cl.[2] ..... E05F 1/10

[58] Field of Search ..... 49/386, 394

[56] References Cited

UNITED STATES PATENTS

| | | | |
|---|---|---|---|
| 2,839,791 | 6/1958 | Lee | 49/386 X |
| 3,184,803 | 5/1965 | Peel | 49/395 X |
| 3,432,967 | 3/1969 | Simon | 49/386 X |

*Primary Examiner*—Kenneth Downey

*Attorney, Agent, or Firm*—Douglas L. Carlsen

[57] ABSTRACT

A door for closing an opening through a pet confining wall in a building, kennel, pen or the like, said door having a peripheral frame for mounting in the wall opening, a door member having its upper edge portion hinged to the frame on a horizontal axis for swinging movement of the door in either direction from a vertical closed position within the frame, and a spring tensioned slide acting between the frame and a cam on the upper edge of the door to yieldably retain the door in closed position.

4 Claims, 5 Drawing Figures

PET DOOR

Domestic pets such as cats and dogs are frequently provided by their owners with shelters with an opening in the wall thereof through which the pet may enter or leave the shelter at will. Most frequently the shelter is a doghouse or a garage or other outbuilding. It is desirable that there be some sort of door or gate mounted to cover the opening to keep wind, snow, dust and the like out of the shelter. Generally this has taken the form of a flap of flexible material attached along its upper edge or a door hinged along its upper edge to the shelter wall and hanging downwardly over the opening but freely swingable in either direction to allow passage of the pet into or out of the shelter. Such a door gravitationally centers itself in closed position until opening force is applied to it.

While it is, of course, possible to lock such a door in its closed position, it is normally left unlocked for ingress or egress and this permits free swinging of the door under wind pressures permitting occasional undesirable entrance of rain, snow and dirt into the shelter.

The object of the present invention is to provide a pet door which is swingable between open and closed positions with a spring tensioned means for always returning the door to its closed position and retaining it there against wind pressures but which will permit the door to be opened when physical force is applied thereto.

Another object of the invention is to provide a new and improved pet door which is durable, economical to manufacture, and readily mountable in a doorway opening of a doghouse or the like.

With these and other ojbects in mind the invention broadly comprises a door assembly having a planar rectangular outer frame defining the doorway and adapted to be mounted in an opening in a doghouse or garage wall or the like, a door shaped to fit within and close the doorway and having its upper edge portion hingedly connected to the frame on a horizontal axis for swinging movement of the door from a centered closed position within the frame to open positions at either side of the plane of the frame and a spring means acting between the frame and door to yieldably retain the door in such centered position. The invention more specifically resides in the location and construction of said spring means. It includes a slide member on the frame biased downwardly by a spring against a cam on the upper edge of the door with the slide member and cam having mating flat surfaces. Preferably, two of such spring means are provided in spaced relation along the upper edge of the door.

DESCRIPTION OF THE PREFERRED EMBODIMENT

Figure 1:
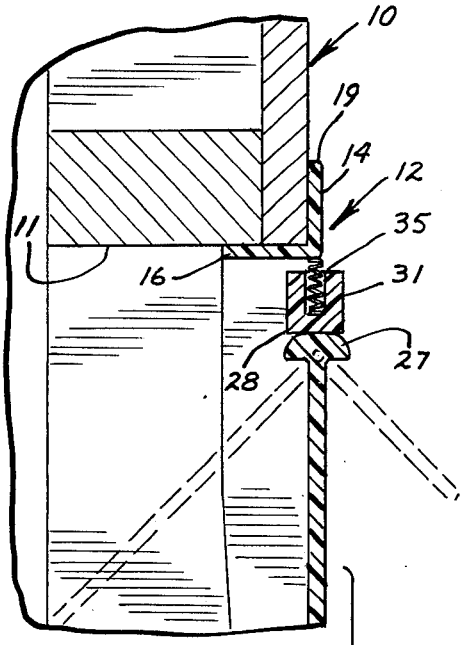
FIG. 1 is a front elevation of the door assembly mounted in a shelter wall.

Referring now more particularly to the drawings reference numerals will be used to denote like elements and structural features in the different views. A wall of a shelter such as a garage or doghouse is denoted generally by the number 10. Wall 10 is provided with a rectangular opening 11.

The door assembly is denoted generally by the number 12. It includes a rectangular frame 14 adapted to be secured to the wall 10 as by screws 15 in encircling relation with respect to opening 11. The frame may also be provided with top 16 and side flanges 17 which fit snugly within the opening 11. Frame 14 defines a rectangular doorway 18 therewithin which is slightly smaller than the opening 11. The upper cross member in the frame 14 is denoted by the numeral 19.

Figure 5:
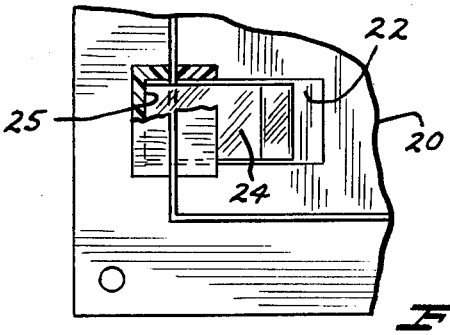
FIG. 5 is a front elevation of the latching mechanism partially broken away to show the latch in locking position.

A rectangular door 20 which fits within the doorway 18 to completely close the same is mounted in the frame 14 by means of horizontally aligned pins 21 extending outwardly from the upper edge portion of the door and journaled for rotation in the side portions of frame 14 permitting the door to swing in either direction from a central position in the opening 18. The lower portion of the door has a pair of seats 22 (FIG. 5) for slidably holding latch members 24 which may be moved outwardly to engage in catches or sockets 25 in the frame 14 to lock the door 20 in closed position.

Figure 2:
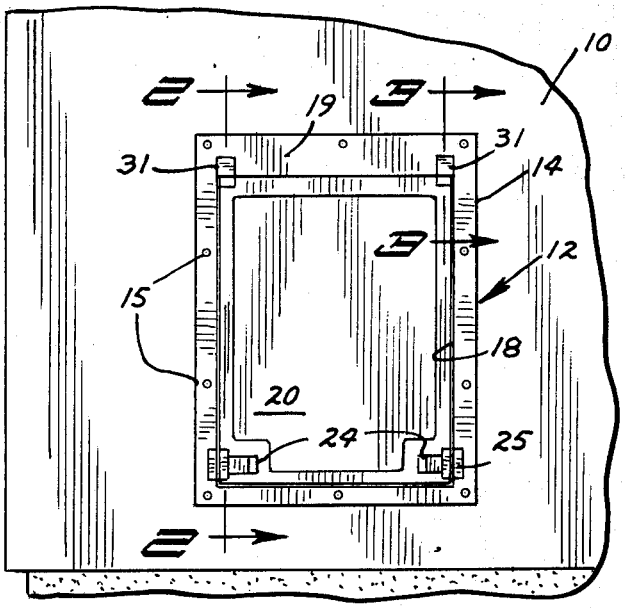
FIG. 2 is an enlarged broken vertical section through the door taken on line 2—2 of FIG. 1.
Figure 2:
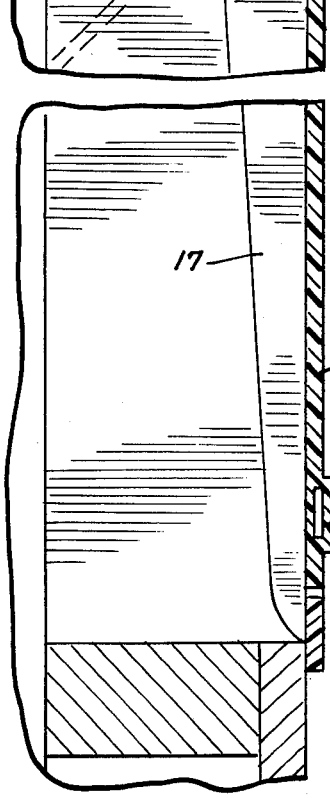
Figure 3:
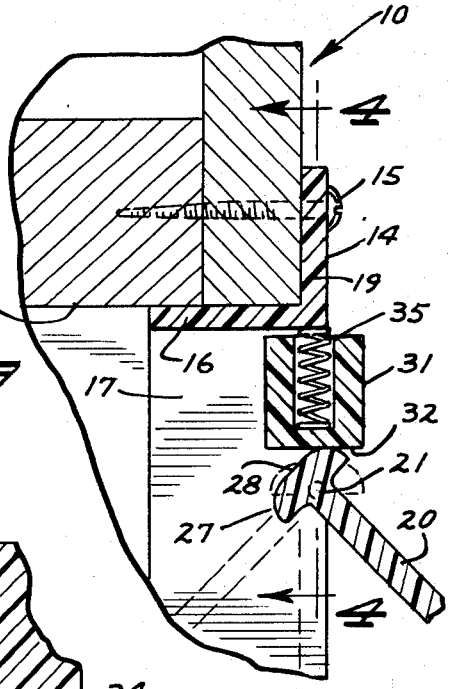
FIG. 3 is a further enlarged fragmentary vertical section taken on line 3—3 of FIG. 1 showing the upper portion of the door in partially open position.

The mechanism for yieldably retaining the door 20 in its centered or closed position will now be described. Door 20 is provided along its upper edge with a pair of spaced cams 26 which are formed integrally with the door. These cams have a generally dome shape in cross section perpendicular to the plane of the door as seen in FIGS. 2 and 3 with rounded cam surfaces 27 formed generally with pins 21 as center axes connected by a flat central portion 28. The portion 28 is aligned with the top edge of door 20.

Figure 4:
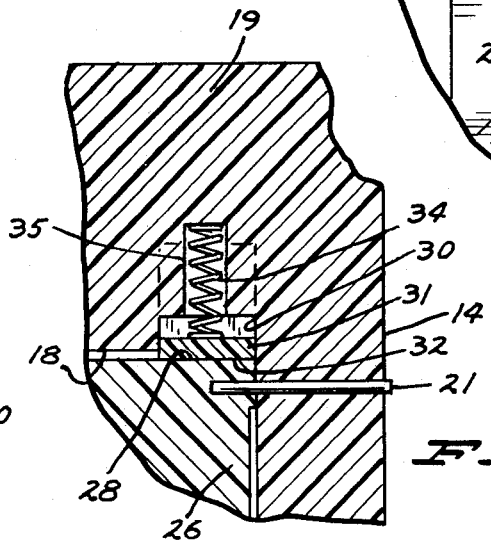
FIG. 4 is a vertical section taken on line 4—4 of FIG. 3.

The cross member 19 of frame 14 is provided with a pair of spaced recesses positioned one about each cam 26. This recess may be best observed in FIG. 4 and it will be noted that it has a wide portion 30 for receiving the bight portion of an upwardly opening U-shaped slide 31 which slidably engages both sides of member 19 for vertical movement thereon. The bottom surface 32 of slide 31 is flat for flush engagement against the flat surface 28 on the cam 26. Above the wide portion 30 of each recess there is a narrower portion 34 which serves as a socket for seating a spiral spring 35 held under compression between the upper end of socket 34 and the slide 31. These springs 35 bias the slides 31 at each side of the door downwardly against the cams 26.

The downward pressure of the slides 31 against the cams 26 tends to retain the surfaces 28 and 32 in flush engagement so that the door 20 is yieldably retained in vertical or closed position. The springs are sufficiently strong to retain the door closed against opening pressures that might be exerted by winds or small rodents. However, when more substantial physical pressure is exerted, such as a dog or cat is capable of, the door may swing about pins 21, as shown in FIG. 3, to allow such pet to pass through the doorway 18. During such opening movement the rounded surfaces 27 on the cams will force the slide upwardly against the spring pressure. When the opening pressure on the door is removed the spring pressure will return the door to its closed position.

It is desirable that the door 20 be formed of a hard plastic material due to its lightness. Also, the cam members can be molded integrally with the door and slide freely along the slide surface 32 during opening and closing movement.

Having now therefore fully illustrated and described my invention, what I claim to be new and desire to protect by United States Letters Patent is:

1. In a pet door assembly for mounting in an opening in a shelter wall to permit entrance or exit of an animal pet at its will, a. a frame for mounting on the wall to define a doorway within said opening, b. a flat door having substantially the same shape and size as said doorway positioned to close the doorway and having its upper portion hinged to the frame on a horizontal axis for swinging movement of the door from a normal vertical closed position within the doorway to open positions in either direction, c. said door having an upwardly facing cam on the upper edge thereof, said cam having a dome shape in cross section perpendicular to the plane of the door and having rounded cam surfaces connected by a flat central portion which is parallel to the upper edge of the door, d. a slide member mounted on the upper portion of the frame for vertical sliding movement and having a flat bottom face in flush engagement with the flat central portion of the cam, and e. spring means disposed between the slide and the frame to yieldably retain said face and portion in such flush engagement.

2. The subject matter of claim 1 wherein said door and cam are formed of hard plastic material.

3. The subject matter of claim 1 wherein the assembly is provided with two of said cams and slide members mounted in horizontally spaced relation.

4. The subject matter of claim 1 wherein the door is provided with a slidable latch member near its lower edge and the frame is provided with a socket for receiving the latch member to positively lock the door in closed position.

* * * * *